US007410390B2

(12) United States Patent
Watanabe et al.

(10) Patent No.: US 7,410,390 B2
(45) Date of Patent: Aug. 12, 2008

(54) ELECTRICAL RECEPTACLE CONNECTOR WITH SHELL

(75) Inventors: Tsuneki Watanabe, Yokohama (JP); Gwou-Jong Tseng, Tu-Cheng (TW); Meng-Huan Yang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/645,433

(22) Filed: Dec. 26, 2006

(65) Prior Publication Data

US 2007/0149055 A1 Jun. 28, 2007

(30) Foreign Application Priority Data

Dec. 26, 2005 (TW) ..... 4222617 U

(51) Int. Cl.
*H01R 13/648* (2006.01)

(52) U.S. Cl. ..... 439/607

(58) Field of Classification Search ..... 439/607, 439/676

See application file for complete search history.

(56) References Cited

U.S. PATENT DOCUMENTS

| | | | | |
|---|---|---|---|---|
| 6,077,120 | A * | 6/2000 | Futatsugi et al. | 439/607 |
| 6,280,209 | B1 | 8/2001 | Bassler et al. | |
| 6,315,608 | B1 | 11/2001 | Lopata et al. | |
| 6,439,931 | B1 * | 8/2002 | Niitsu et al. | 439/660 |
| 6,447,311 | B1 | 9/2002 | Hu et al. | |
| 6,482,037 | B1 | 11/2002 | Zhu et al. | |
| 2007/0105440 | A1 * | 5/2007 | Delaney et al. | 439/607 |

* cited by examiner

*Primary Examiner*—Briggitte R Hammond
(74) *Attorney, Agent, or Firm*—Wei Te Chung

(57) ABSTRACT

An electrical connector (100) adaptor for connecting with a complementary connector in a mating direction, comprises a shell (1), an insulative housing (2) received in the shell and a plurality of contacts (3) received in the housing. The shell comprises a top surface (11), a pair of lateral surfaces (13, 14), respectively, connecting with the top surface, and a rear surface (15), respectively, bent from the lateral surfaces. The two-part rear surface comprises a base plate (151) and a shielded plate (152) extending rearwardly from the base plate. Each contact comprises a tail portion (32) exposed out of the insulative housing. The shielded plate is above and covers the tail portions of the contacts.

16 Claims, 4 Drawing Sheets

ELECTRICAL RECEPTACLE CONNECTOR WITH SHELL

CROSS-REFERENCE

This is related to U.S. patent application Ser. No. 11/401,082 filed on Apr. 10, 2006 and entitled "ELECTRICAL CONNECTOR ASSEMBLY WITH MULTI-FUNCTION LATCHING MEMBER" which have the same applicant and assignee as the present invention.

BACKGROUND OF THE INVENTION

1. Field of the Invention

The present invention relates to an electrical connector, and particularly to a micro electrical connector for mating with a complementary connector.

2. Description of Prior Arts

A normal USB receptacle connector comprises an insulative housing, a shell enclosing the insulative housing and a plurality of contacts received in the insulative housing. Each contact always comprises a tail portion for soldering to an electronic member, such as a motherboard. The tail portions are exposed out of the insulative housing and the shell. However, as the development, the electronic member becomes more and more smaller. Therefore, the interior space between the electrical connector also becomes smaller. Accordingly the effect of the Electro-Magnetic Interference (EMI) to the discovered tail portions is obvious.

Obviously, it is desirable to have an electrical connector has an improved structure.

SUMMARY OF THE INVENTION

An object of the present invention is to provide an electrical connector to prevent EMI to the contacts.

To achieve the above object, an electrical connector adaptor for connecting with a complementary connector in a mating direction, comprises a shell, an insulative housing received in the shell and a plurality of contacts received in the housing. The shell comprises a top surface, a pair of lateral surfaces, respectively, connecting with the top surface, and a two-parts rear surface, respectively, bent from the lateral surfaces. The two-part rear surface comprises a base plate and a shielded plate extending rearwardly from the base plate. Each contact comprises a tail portion exposed out of the insulative housing. The shielded plate is above and covers the tail portions of the contacts.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
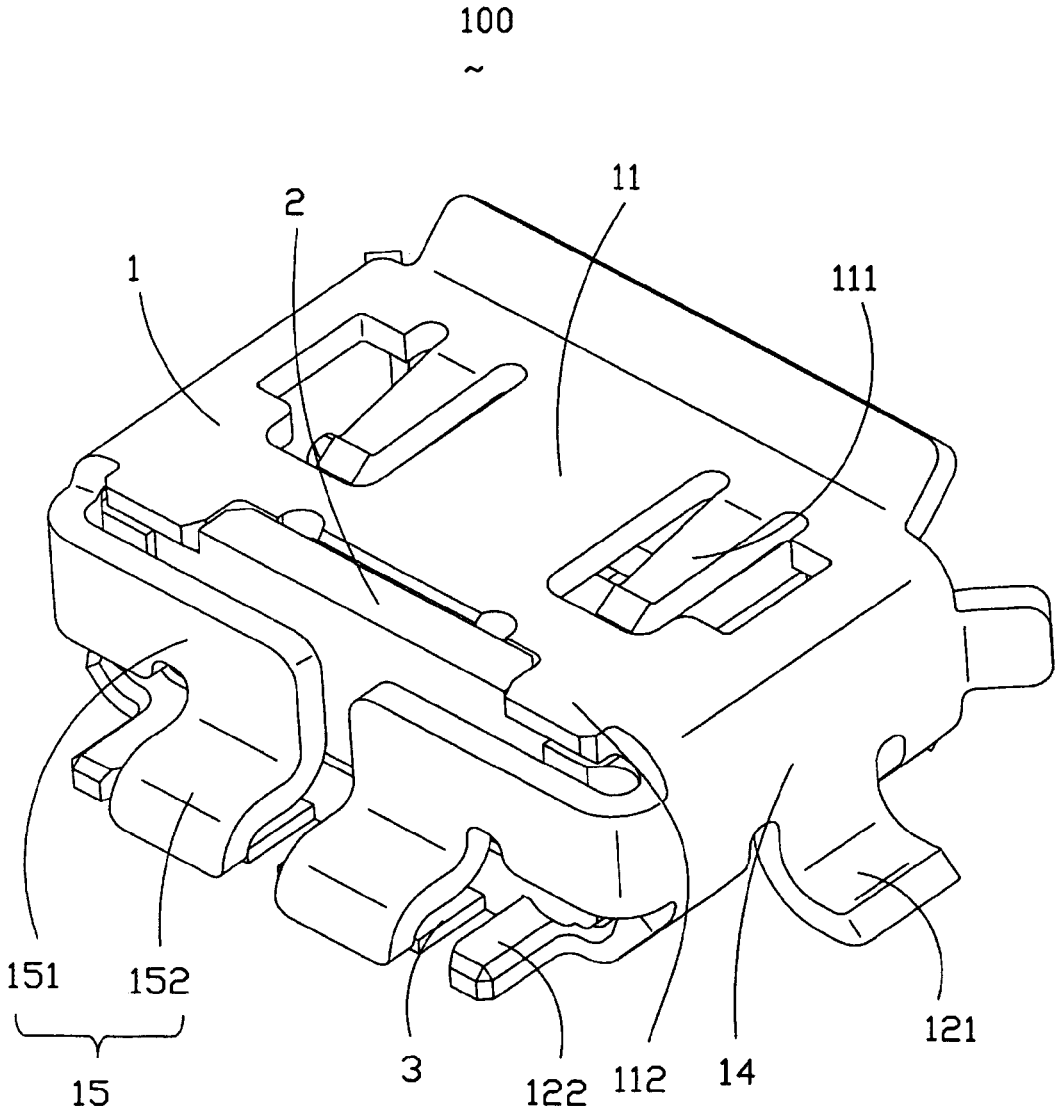
FIG. 1 is an assembled, perspective view of an electrical connector in accordance with the present invention.
Figure 2:
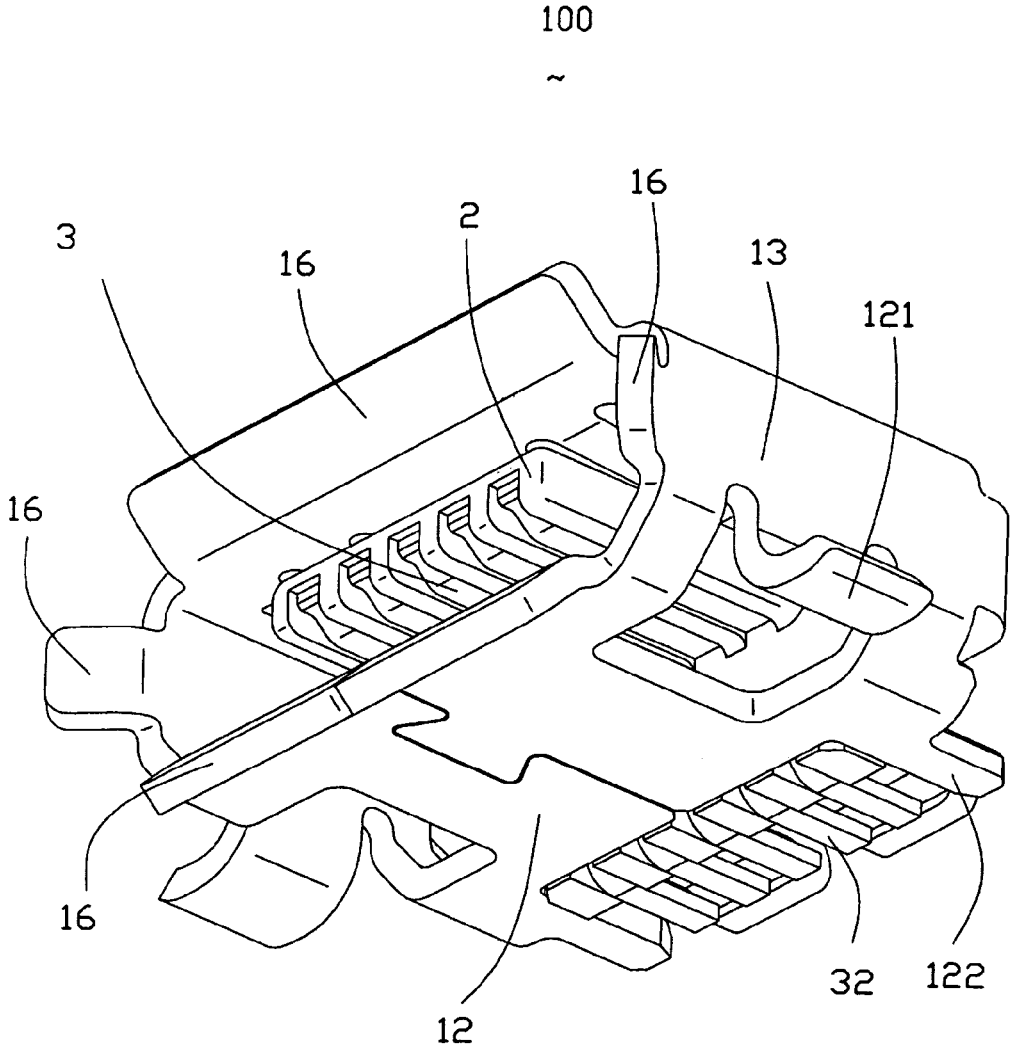
FIG. 2 is a view similar to FIG. 1, but taken from a different aspect.

Referring to FIGS. 1 and 2, an electrical connector 100 comprises a shell 1, an insulative housing received in the shell 1, and a plurality of contacts 3 insert-molded in the insulative housing 2.

Still referring to FIGS. 1 and 2, the shell 1 comprises a top surface 11, a bottom surface 12, a left surface 13, a right surface 14 and a rear surface 15 bent rearwardly from the left surface 13 and the right surface 14. Above-mentioned surfaces together define a receiving room (not labeled). The top surface 11, the bottom surface 12, the left and the right surface 13, 14, respectively, forms a guiding surface for guiding the complementary connector (not shown). The top surface 11 comprises a resilient tab 111 bent into the receiving room for resisting the shield (not shown) of the complementary connector. The top surface 11 comprises a pair of holding portions 112 extending rearwardly from the opposite ends of a rear edge thereof. The holding portions 112 and the rear surface 15 together define a receiving space (not labeled). The left surface 13 and the right surface 14, respectively, forms a positioning 121 tab extending outwardly therefrom for positioning the electrical connector 100 on the motherboard (not shown) during soldering. The bottom surface 15 comprises a pair of restricting tabs 122 extending rearwardly from the opposite ends of a rear edge thereof. The rear surface 15 comprises a base plane 151 and a shielded plane 152 extending rearwardly from the base plane 151.

Figure 3:
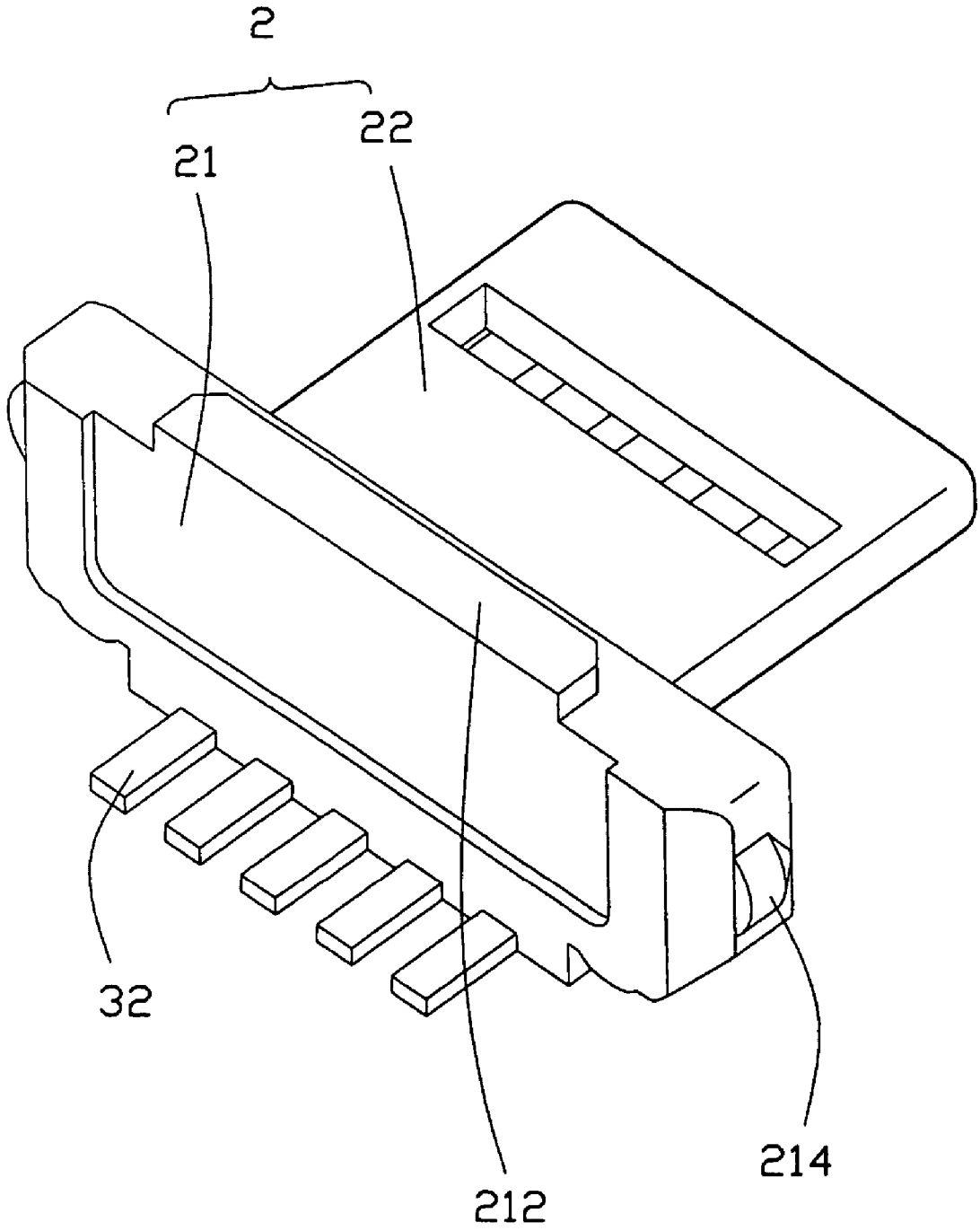
FIG. 3 is a perspective view of an insulative housing with the contacts assembled on of the electrical connector shown in FIG. 1.
Figure 4:
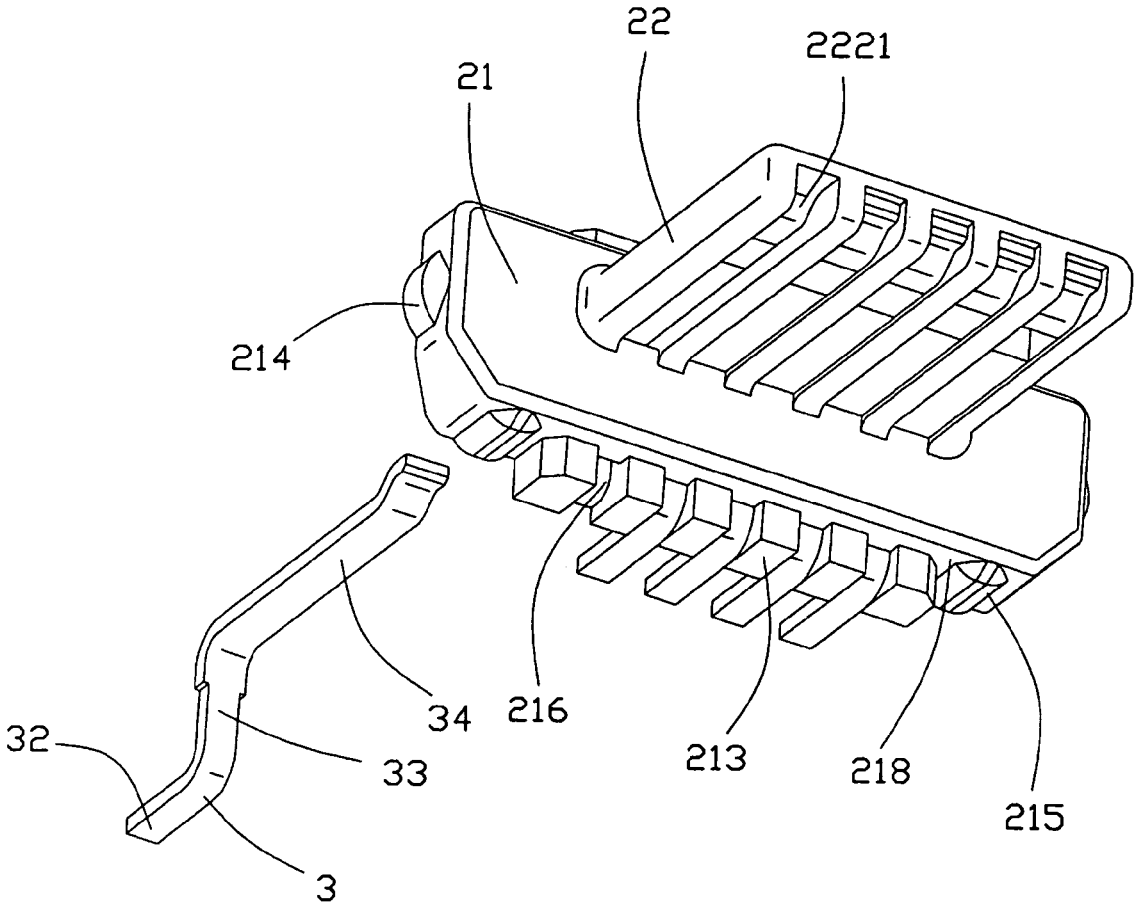
FIG. 4 is a view similar to FIG. 1, but taken from a different aspect, with a contact is pulled out of the insulative housing.

Referring to FIG. 3 and FIG. 4, the insulative housing 2 comprises a main body 21 and a mating portion 22 extending forwardly from the main body 21. The main body 21 comprises a retaining block 212 projecting upwardly therefrom. The retaining block 212 is located between the holding portions 112 of the shell 1 for restricts the movement in a front-to-back direction of the housing 2. A plurality of blocks 213 are alternatively formed at a bottom wall 218 of the main body 21 engaging with the bottom surface 12 of the shell 1. A plurality of slits 216, respectively, forms between every two adjacent blocks 213. A pair of stopping blocks 215 are formed at the opposite ends of the bottom wall for engaging with the restricting tabs 122 of the shell to restrict the movement in a lateral direction of the housing 2. A pair of engaging blocks 214 are formed at the opposite ends of the main body 21 for engaging with the inner surface of the left and right surface 13, 14 of the shell 1. The mating portion 22 defines a plurality of receiving slots thereon.

Each contact 3 comprises a contacting portion 34, a retaining portion 33 extending downwardly from the contacting portion and a tail portion 32 extending rearwardly from the retaining portion 33. The contacting portions 34 are received in corresponding slots 2221. The retaining portions 33 are insert-molded in the housing 2. The tail portions are exposed out of the housing 2 and located between the slits 216 of the housing. Furthermore, the tail portions are fixed between the restricting tabs 122 of the shell 1 and under the shielded planes 152 of the shell 1. The restricting tabs 122 prevent Electro-Magnetic Interference (EMI) to the tail portions 32 from the lateral direction. The shielded planes 152 prevent EMI to tail portions 32 from the front-to-back direction and an up-to-down direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector adaptor for connecting with a complementary connector in a mating direction, comprising:

a shell comprising a top surface, a pair of lateral surfaces, respectively, connecting with the top surface, and a rear surface, these surfaces defining a receiving room, the rear surface comprises a base plate and a shielded plate extending rearwardly from the base plate;

an insulative housing received in receiving room of the shell; and a plurality of contacts received in the insulative housing, each comprises a tail portion extending rearwardly and exposed out of the insulative housing;

wherein the shielded plate is above and covers the tail portions of the contacts;

wherein the shell further comprises a bottom surface connecting with the lateral surfaces, the bottom surface comprising a pair of restricting tabs at the opposite ends of a rear thereof;

wherein the insulative housing comprises a pair of stopping blocks engaging with the restricting tabs.

2. The electrical connector as described in claim 1, wherein the contacts are insert-molded with the insulative housing.

3. The electrical connector as described in claim 2, wherein each contact comprises a contacting portion and a retaining portion extending from the contacting portion, and said tail portion extending from the retaining portion.

4. The electrical connector as described in claim 1, wherein the insulative housing comprises a pair of engaging blocks engaging with the lateral surfaces.

5. The electrical connector as described in claim 1, wherein the top surface comprises a pair of resilient tabs extending into the receiving room and engaging with the insulative housing.

6. The electrical connector as described in claim 3, wherein the insulative housing comprises a main body and a mating portion extending from the main body, said contacting portions of contacts are located at the mating portion, and the retaining portions of the contacts are fixed in the insulative housing.

7. The electrical connector as described in claim 6, wherein the top surface comprises a pair of holding portions extending from the opposite ends of a rear edge thereof, the insulative housing comprises a retaining block projecting from the main body thereof and located between the holding portions of the shell.

8. The electrical connector as described in claim 1, wherein the top surface, the lateral surface, respectively, forms a guiding surface for guiding the complementary connector.

9. The electrical connector as described in claim 1, wherein said tail portions are located between the restricting tabs of the shell.

10. The electrical connector as described in claim 1, wherein said rear portion comprises two parts, respectively, bent from a pair of lateral surfaces of the shell.

11. An electrical connector assembly comprising:

an insulative housing essentially defining essentially a lying T-shaped cross-section including a horizontal mating tongue and a vertical rear wall;

a plurality of contacts disposed in the housing;

a metallic shell enclosing said housing and cooperating with the mating tongue to define a mating port therein and cooperating with the rear wall to retain the shell to the housing; and each of said contacts defining a contacting portion extending into the mating port around the mating tongue and a mounting portion extending horizontally and rearwardly out of the rear wall; wherein the shell includes a rear portion including a vertical section forwardly confronting and closely, in a horizontal direction, covering the rear wall, and a horizontal section extending rearwardly from the vertical section to closely, in a vertical direction, cover the mounting portions; wherein the vertical section is essentially parallel to the rear wall while the horizontal section is essentially perpendicular to the rear wall.

12. An electrical connector assembly comprising:

an insulative housing essentially defining essentially a lying T-shaped cross-section including a horizontal mating tongue and a vertical rear wall;

a plurality of contacts disposed in the housing with thereof corresponding mounting portions exposed rearwardly outside of the vertical rear wall;

a metallic shell enclosing said housing and cooperating with the mating tongue to define a mating port therein and cooperating with the rear wall to retain the shell to the housing; and the shell defines a cutout around a rear edge thereof to receive an upward protrusion of the rear wall so as to prevent forward and sideward movement of the rearward relative to the shell, and the shell further includes a rear plate bent from a side wall of the shell to abut against an exterior face of the rear wall of the housing so as to prevent a rearward movement of the housing relative to the shell; wherein a shielding plate extend horizontally and rearwardly from the rear plate to closely cover the mounting portions in a vertical direction, and said shielding plate is essentially perpendicular to the rear wall.

13. The electrical connector as described in claim 11, wherein said rear surface comprises two parts, respectively, bent from the lateral surfaces.

14. The electrical connector as described in claim 11, wherein the shell defines a cutout around a rear edge thereof to receive an upward protrusion of the housing so as to prevent forward and sideward movement of the rearward relative to the shell.

15. The electrical connector as described in claim 11, wherein said vertical section and said horizontal section commonly defines an essentially L-shaped configuration in a transverse side view.

16. The electrical connector as described in claim 13, wherein an outermost edge of said horizontal section is downwardly curved to partially cover the mounting portions in said horizontal direction.

* * * * *